US007032323B2

(12) United States Patent
Süss

(10) Patent No.: US 7,032,323 B2
(45) Date of Patent: Apr. 25, 2006

(54) DEVICE AND METHOD FOR COMPACTING A FIBER COMPOSITE

(75) Inventor: Paul Süss, Bettwiesen (CH)

(73) Assignee: Solipat AG, Zug (CH)

( * ) Notice: Subject to any disclaimer, the term of this patent is extended or adjusted under 35 U.S.C. 154(b) by 0 days.

(21) Appl. No.: 10/509,731

(22) PCT Filed: Mar. 28, 2003

(86) PCT No.: PCT/EP03/03218

§ 371 (c)(1),
(2), (4) Date: Sep. 30, 2004

(87) PCT Pub. No.: WO03/083394

PCT Pub. Date: Oct. 9, 2003

(65) Prior Publication Data

US 2005/0252034 A1 Nov. 17, 2005

(30) Foreign Application Priority Data

Apr. 2, 2002 (EP) ..... 02405255

(51) Int. Cl.
*F26B 7/00* (2006.01)

(52) U.S. Cl. ..... 34/381; 34/638

(58) Field of Classification Search ..... 34/638, 34/381

See application file for complete search history.

(56) References Cited

U.S. PATENT DOCUMENTS

| | | | | |
|---|---|---|---|---|
| 4,069,595 A | | 1/1978 | Ahlbert et al. | |
| 4,467,537 A | | 8/1984 | Trotscher | |
| 4,848,633 A | | 7/1989 | Hagen et al. | |
| 5,274,892 A | * | 1/1994 | Strahm | 26/20 |
| 5,564,200 A | | 10/1996 | Strahm | |
| 5,946,819 A | * | 9/1999 | Reimer et al. | 34/541 |
| 6,058,626 A | * | 5/2000 | De Vroome et al. | 34/539 |
| 6,131,308 A | * | 10/2000 | Kramer et al. | 34/633 |

FOREIGN PATENT DOCUMENTS

| | | |
|---|---|---|
| DE | 3023225 | 8/1982 |
| DE | 210739 | 6/1984 |
| DE | 29900646 | 6/1999 |
| EP | 0000111 | 12/1978 |
| EP | 0619465 | 10/1994 |
| EP | 0810413 | 12/1997 |
| EP | 0935112 | 8/1999 |
| FR | 2225706 | 11/1974 |
| GB | 744043 | 2/1956 |

* cited by examiner

*Primary Examiner*—S. Gravini
(74) *Attorney, Agent, or Firm*—Shoemaker and Mattare

(57) ABSTRACT

Disclosed are a device and a method for compacting a continuously conveyed fiber composite (V) by means of heat (W) impingement. A heated treatment medium (L) is blasted towards the fiber composite (V) by means of at least one nozzle arrangement (2*a*, 2*b*). Said nozzle arrangement (2*a*, 2*b*) comprises a plurality of adjacent blasting nozzles (4) which are disposed at a distance (a) from each other. An intermediate space (5) is formed between two adjacent nozzles (4). Said intermediate space (5) between blasting nozzles (4) is essentially closed to the fiber composite (V) counter to the conveying path (F) such that an overpressure (P) can be created in a pressure chamber (6) located between the nozzle arrangement and the surface (O) of the fiber composite (V), whereby the treatment medium (L) can be blasted through the entire thickness of the fiber composite (V) even when said fiber composite has a great thickness.

16 Claims, 6 Drawing Sheets

DEVICE AND METHOD FOR COMPACTING A FIBER COMPOSITE

Figure 1:
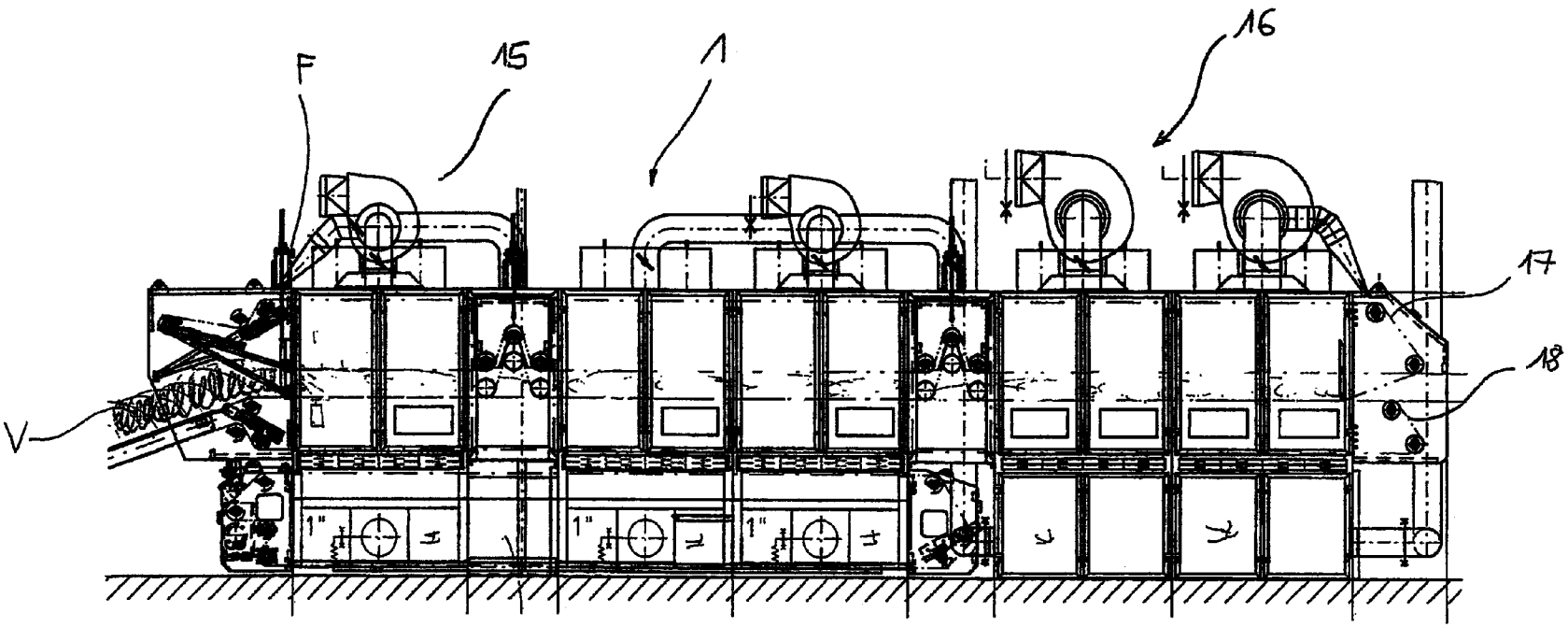

The invention relates to a device and method for consolidating a fiber composite, having the features of the preamble of the independent patent claims.

Such a fiber composite is often also designated as a nonwoven. The fiber composite consists of a mixture of basic fibers, for example cotton fibers or flax fibers, and of binding fibers, for example meltable plastic fibers. Binding fibers can be melted by heating. Loose fiber composite can thereby be consolidated. To consolidate such fiber composites, it is known to convey the fiber composite continuously along a conveying path in a drier device and at the same time act upon said fiber composite with heat. The fiber composite is subsequently cooled. The nonwoven mat produced in this way may be used, for example, as upholstery, insulating material or mattresses or as a cosmetic product (wadding).

There are various known devices for consolidating such a fiber composite or for acting upon the fiber composite with heat.

In what may be referred to as through-suction driers, air in a drying device is sucked through the fiber composite in a direction transverse to the conveying direction. In such driers, a satisfactory action of heat upon the fiber composite can be achieved over the entire thickness of the latter. However, such devices have some disadvantages. To carry out this method, a vacuum has to be generated on one side of the conveyed fiber composite. Heated air is sucked away from a chamber on the opposite side. For this purpose, this chamber is provided with orifices, for example slots, which run transversely to the conveying direction of the fiber composite. To ensure that the air is sucked through the fiber composite, it is necessary to adapt the width of these orifices to the width of the respective fiber composite. For this purpose, covers are provided, by means of which the active width of the orifices of the chamber can be set. The heating zone is followed by a cooling zone which is of essentially identical construction. Such devices are complicated to operate, however, since the device has to be adapted in each case to the width of the fiber composite to be treated. One such through-suction drier is shown, for example, in IDE 299 00 646 Ul.

In another type of such devices, the device is designed as a blow drier. Such a device is known, for example, from IDE 30 23 229. In this case, heated air is blown against the fiber composite by means of blowing nozzles. It became apparent that such blow driers can be used satisfactorily in the case of relatively thin fiber composites. However, problems may arise in the production of thicker mats, for example in the range of above 5 cm, because the air cannot be blown through the entire thickness of the fiber composite. It was shown that the hot air blown against the fiber composite from one side enters the fiber composite, but is as it were reflected by the latter and emerges from the fiber composite again on the same side. In the treatment of thicker fiber composites, above all, therefore, in a middle region a zone occurs which is not acted upon sufficiently with heat and in which the binding fibers are not sufficiently melted. The fiber composite is therefore not consolidated uniformly over its entire thickness.

Accordingly, an object of the present invention is to avoid the disadvantages of the prior art, that is to say, in particular, to provide a method and a device for consolidating a fiber composite, which allow a uniform consolidation of the fiber composite over its entire thickness, even in the case of relatively thick fiber composites. However, the device and the method are also to be capable of being used for the treatment of thin fiber composites.

According to the invention, these objects are achieved by means of a device and by means of a method according to the features of the characterizing part of the independent patent claims.

In the device for consolidating the fiber composite, the fiber composite is conveyed continuously along a conveying path. Consolidation takes place by the action of heat upon the fiber composite. The device has at least one nozzle arrangement. The at least one nozzle arrangement is arranged on at least one side of the conveying path. The nozzle arrangement serves for blowing a heated treatment medium toward the fiber composite in the direction of the conveying path. The treatment medium typically used is air. However, other treatment media would also be conceivable. The at least one nozzle arrangement has a plurality of blowing nozzles lying next to one another, that is to say the device is designed as a blow drier. The blowing nozzles are arranged at a distance from one another in the known way, so that a respective interspace is formed in each case between two adjacent blowing nozzles. In order to prevent the treatment medium from being reflected by the fiber composite and flowing out again between the blowing nozzles over the width of the nozzle arrangement, it is proposed, according to the invention, to design the interspace between the blowing nozzles so as to be essentially closed or closable with respect to the conveying path. This ensures that the treatment medium is forced to pass through the entire thickness of the fiber composite. A uniform consolidation of the fiber composite over its entire thickness is thereby ensured.

According to a preferred exemplary embodiment, it is not necessary for the interspace to be closed off in a completely air-tight manner. It is sufficient to close the interspace in such a way that, between the nozzle arrangement and the fiber composite, a pressure space is formed, in which an excess pressure can be generated by means of the blowing nozzles. The excess pressure is to be sufficiently high to force the treatment medium to pass through the entire fiber composite. In other words, therefore, the invention lies in designing a device for consolidating a continuously conveyed fiber composite in such a way that a treatment medium can be blown through the entire thickness of the fiber composite, even in the case of a relatively thick fiber composite, typically with a thickness of more than 5–10 cm. when the device is used to consolidate relatively thin fiber composites, it is also conceivable to open the interspaces between the blowing nozzles.

According to a preferred exemplary embodiment, therefore, the interspace is closed off or closable in such a way that, in the case of a predetermined fiber composite (in particular, in the case of a predetermined material, predetermined density and predetermined thickness) and in the case of a predetermined outflow velocity and outflow quantity of the treatment medium from the blowing nozzles, the treatment medium can be blown through the entire thickness of the fiber composite.

Advantageously, in this regard, the blowing nozzles have a blowing orifice which terminates adjacently to the surface of the fiber composite. Since the blowing orifice is arranged as near as possible to the surface of the fiber composite, the treatment medium can be blown directly into the fiber composite.

A rotating upper and lower belt, between which the fiber composite is conveyed, conventionally serves for conveying the fiber composite in such a device. The upper belt or the lower belt is permeable to the treatment medium. According to this preferred exemplary embodiment, the aim is to arrange the blowing orifice as near as possible to the upper belt or to the lower belt. In order to ensure as short a distance as possible between the blowing orifice and the surface of the fiber composite, even in the case of fiber composites of different thickness, according to a further preferred exemplary embodiment the distance between the surface of the fiber composite and the blowing orifice of the blowing nozzles is adjustable.

To close off the interspace between the blowing nozzles, it is conceivable to use sealing elements which can be inserted into the interspace between the blowing nozzles. In particular, the sealing elements used may be plates which can be pushed in between the blowing nozzles.

The blowing nozzles are preferably designed as wide-slit nozzles. The wide-slit nozzles extend essentially over the entire width of the conveying path in the device. The blowing nozzles are advantageously provided with a nozzle box having a cross section which decreases from a connecting orifice, out of which the treatment medium can be blown into the nozzle box, toward a closed end of the nozzle box. This measure, known per se in the sector of driers, ensures that the outflow velocity or the outflow quantity of the treatment medium remains essentially constant over the entire width of the conveying path or of the fiber composite transversely to the conveying direction. The blow-out velocity or blow-out quantity of the treatment medium is in this case independent of the width of the fiber composite to be treated. Since the flow resistance is generated by the wide-slit nozzle, the width of the fiber composite has no influence on the outflow behavior of the treatment medium from the blowing nozzle.

According to a further preferred exemplary embodiment, nozzle arrangements are arranged on both sides of the conveying path. So that the device can operate according to the invention as a blow drier, by means of which treatment medium can be blown through the entire width of the fiber composite, it is expedient to arrange the blowing nozzles alternately on one side of the conveying path and on the other. Alternatively, it is also conceivable to arrange blowing nozzles simultaneously on both sides of the conveying path, but in each case to activate only the blowing nozzles on one side or on the other.

According to a further preferred exemplary embodiment, a plurality of blowing nozzles are combined into groups. The groups of blowing nozzles are in each case activatable and deactivatable individually.

The interspace between deactivated blowing nozzles is in this regard openable or opened. This ensures that treatment medium emerging from the fiber composite can flow out and that a counterpressure cannot build up on the side located opposite the blowing nozzles.

The device according to the invention is provided with at least one fan and with at least one heating device for heating the treatment medium. According to a preferred exemplary embodiment, the fan and the heating device are designed in such a way that, with each blowing nozzle, 500 to 2000 $m^3$ of air per hour and per meter of working width, with a temperature of 0 to 300 W and with a velocity of 0.5 to 70 m/s, preferably 20 to 40 m/s, can be blown against the fiber composite.

The method according to the invention serves for consolidating a fiber composite by the action of heat upon the latter. The fiber composite is conveyed continuously along a conveying path. At the same time, a heated treatment medium is blown in the direction of the fiber composite. An excess pressure is consequently generated in a pressure space contiguous to the fiber composite. The treatment medium is thereby blown through the entire thickness of the fiber composite.

According to a preferred exemplary embodiment, the treatment medium is blown into the fiber composite directly from a blowing orifice of the blowing nozzles which is adjacent to the surface of the fiber composite.

According to a further preferred exemplary embodiment, the distance between the blowing orifice of the blowing nozzle and the surface of the fiber composite is set at a predeterminable value before the commencement of the consolidating operation.

According to a further preferred exemplary embodiment, as seen in the conveying direction, the treatment medium is blown toward the fiber composite alternately from one side and from the other side. For this purpose, it is preferable that groups of blowing nozzles on one side of the fiber composite are activated and deactivated alternately, and that the interspace between deactivated blowing nozzles is opened to allow the outflow of the treatment medium. The treatment medium is blown out of the blowing nozzles typically with a temperature of 0 to 300 W and with an outflow velocity of 0.5 to 70 m per second. 500 to 2000 $m^3$ of air per hour are typically blown out per blowing nozzle and per meter of working width.

Both the velocity and the quantity of the blown-out treatment medium respectively lie markedly above the velocity and the outflow quantity of the treatment medium which, in the case of through-suction driers, is sucked through the fiber composite.

Figure 2:
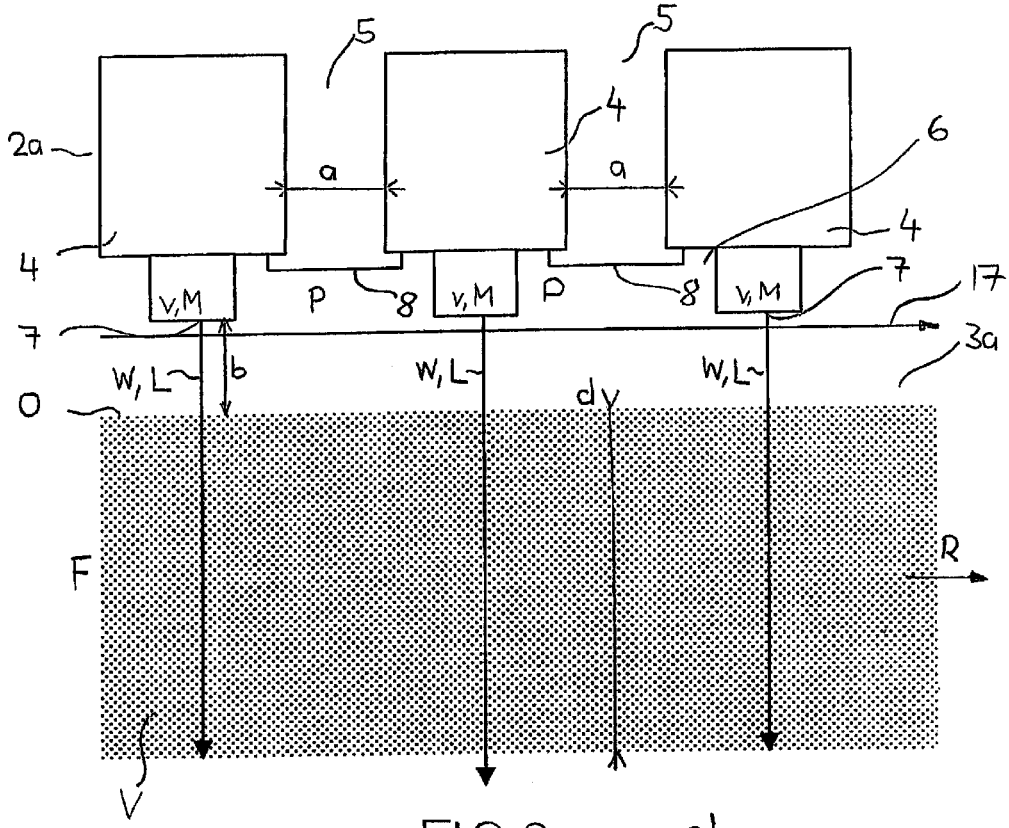
Figure 3:
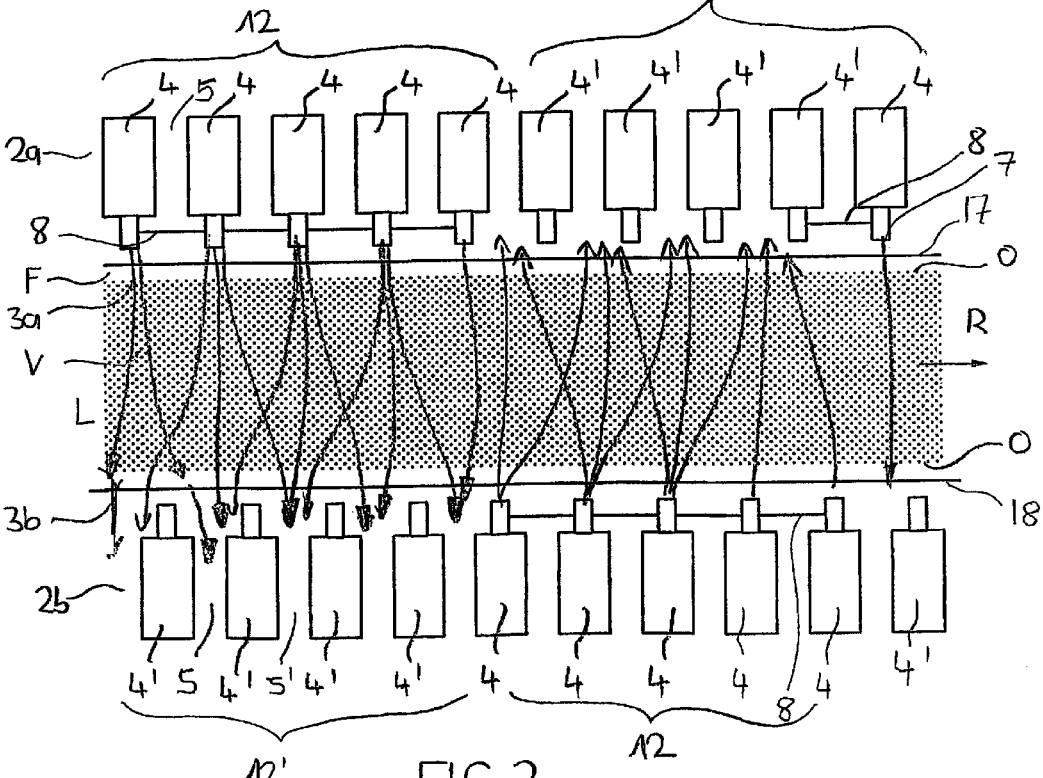
Figure 4:
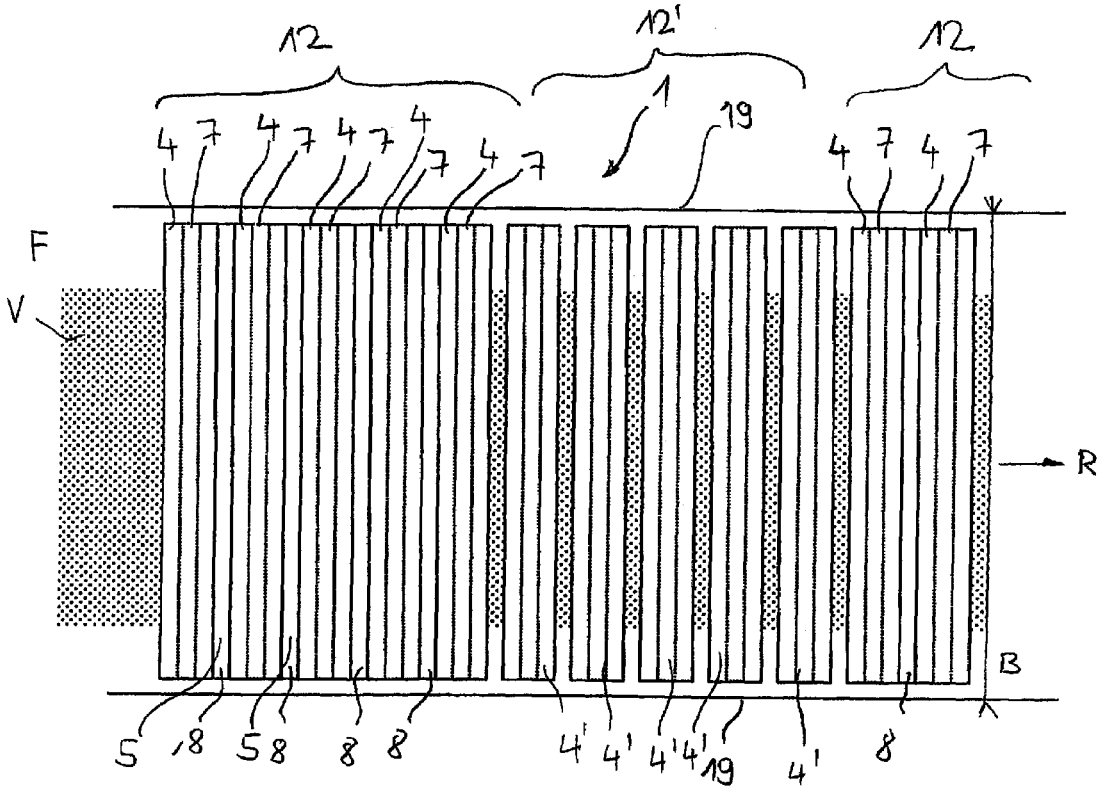
Figure 5:
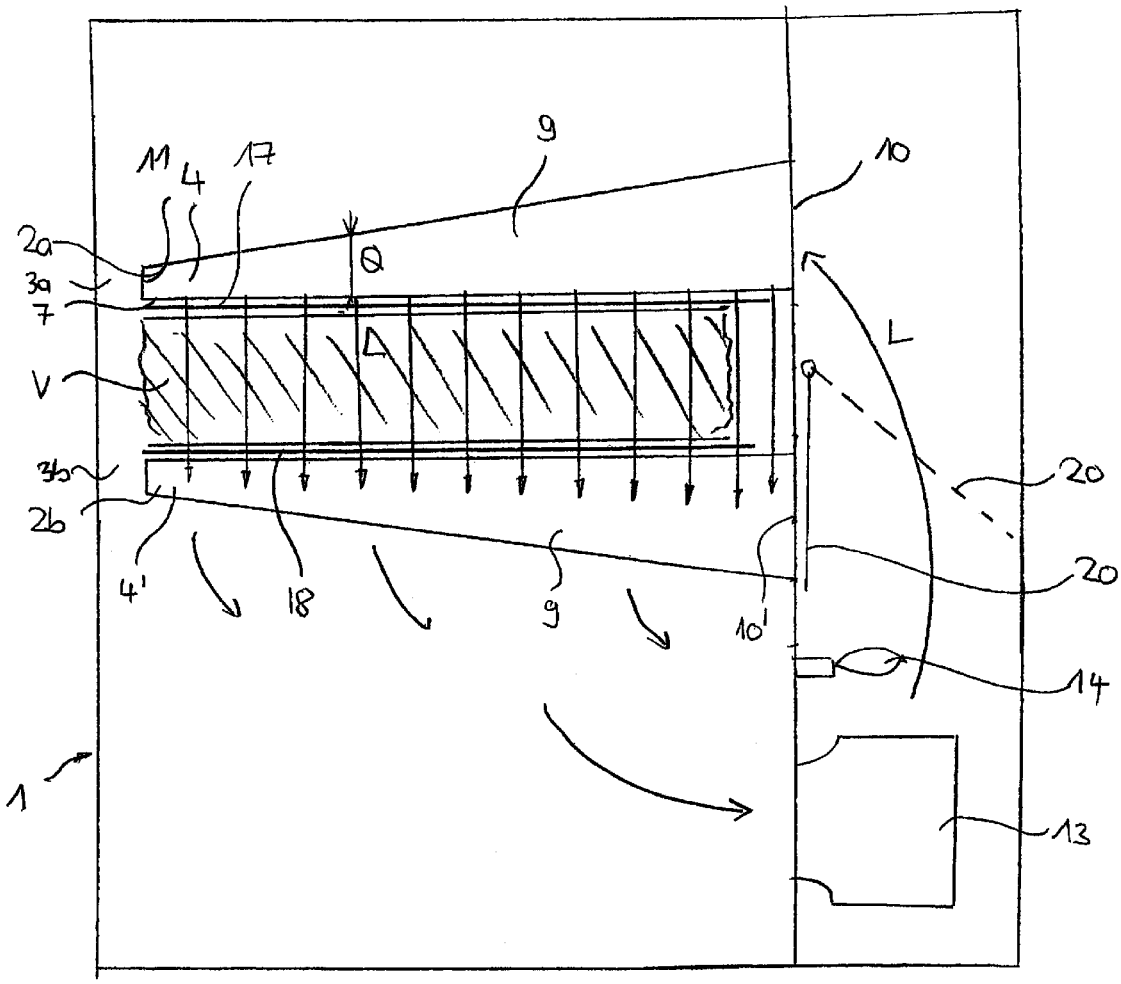
Figure 6:
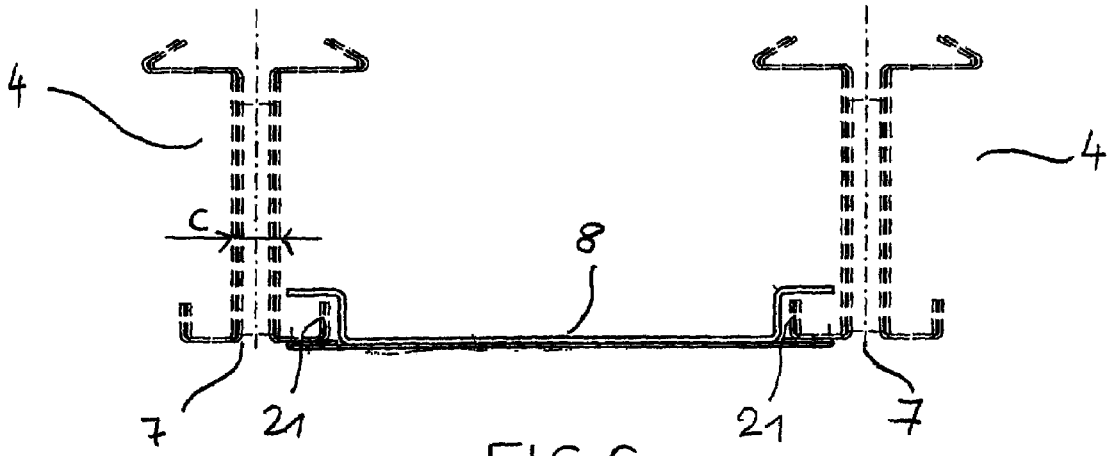
Figure 7:
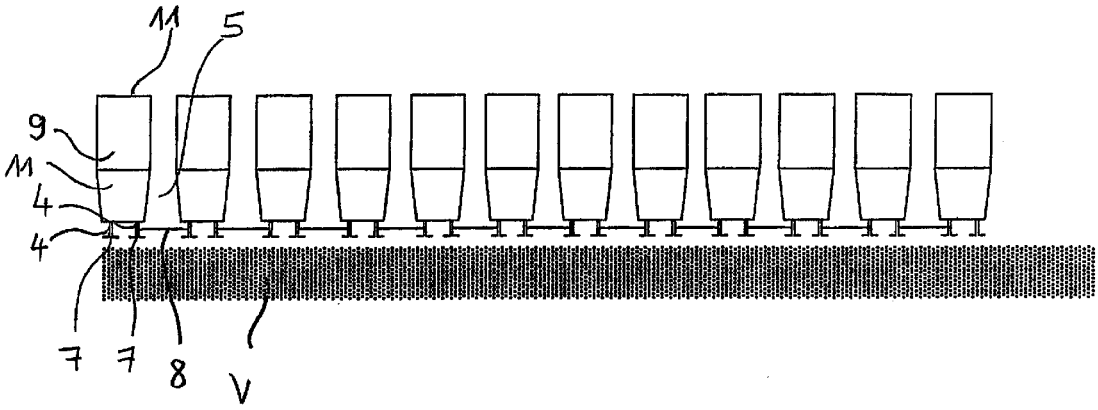

The invention is explained in more detail below in exemplary embodiments and with reference to the drawings in which:

FIG. 1 shows a side view of a device according to the invention for nonwoven consolidation, FIG. 2 shows a diagrammatic illustration of a detail from the device according to the invention with blowing nozzles arranged above and below the fiber composite, FIG. 3 shows a diagrammatic illustration of alternately activated and deactivated blowing nozzles arranged on both sides of the fiber composite, FIG. 4 shows a top view of nozzle arrangements of a device according to the invention, FIG. 5 shows an illustration of a device according to the invention in cross section in a plane perpendicular to the conveying direction, FIG. 6 shows an enlarged illustration of blowing nozzles of a device according to the invention, and FIG. 7 shows a side view of a plurality of nozzle boxes.

FIG. 1 shows a side view of a device 1 according to the invention. The device 1 according to the invention serves for conveying a fiber composite V along a conveying path F. An upper belt 17 and a lower belt 18 are provided for conveying the fiber composite V through the device 1. The upper and lower belts 17, 18 are designed as rotating open-mesh belts which are guided around deflecting rollers in the device 1. The fiber composite V is conveyed between the upper belt 17 and the lower belt 18. The fiber composite V used is typically a mixture of natural fibers, for example cotton or flax fibers, and of a binding fiber, for example a meltable plastic fiber. To consolidate the fiber composite V. the fiber composite is acted upon with heat in a heating portion 15 in the device 1, so that the binding fibers melt and the fiber composite V is consolidated. The consolidated fiber composite V is subsequently cooled in a cooling portion 16. The device 1 is designed as a drier which is provided in a known way with fans, a heating device and air outlets. For consolidation, the treatment medium used is air which is heated to a temperature of 0 to 300 W. Temperatures of up to 250 W can thereby be achieved inside the fiber composite V.

The device 1 is designed as a blow drier. For this purpose, nozzle arrangements 2*a*, 2*b* for acting upon the fiber composite V with heat w are provided on both sides 3*a*, 3*b* (see FIGS. 2 and 3).

FIG. 2 shows a side view of a detail from the device 1 in cross section. The fiber composite V is conveyed through the device 1 along the conveying path F in the conveying direction R. The upper belt 17 or the lower belt 18 serves for conveying the fiber composite V, only the upper part of the device 1 and, correspondingly, only the upper belt 17 being illustrated in FIG. 2.

The nozzle arrangement 2*a* on the top side of the fiber composite V has blowing nozzles 4. The blowing nozzles 4 blow heated air L in the direction of the fiber composite V via a blowing orifice 7. The air L, heated to 300 W, is blown out of the blowing orifices 7 at a velocity v of approximately 40 m/s. Up to 2000 $m^3$ of heated air L per hour is blown out per blowing nozzle 4. The blowing nozzles 4 are arranged at a distance a from one another, so that an interspace 5 is formed between adjacent blowing nozzles 4. According to the invention, the interspace 5 between active blowing nozzles 4 is closed by means of a sealing element 8. In the exemplary embodiment according to FIG. 2, the sealing element 8 is designed as a plate which bridges the interspace 5. In this way, between the nozzle arrangement 2*a* or 2*b* and the surface 0 of the fiber composite V. a pressure space 6 is formed in which an excess pressure P can be generated by means of the blowing nozzles 4. In the arrangement according to the invention, the heated air L is blown through the entire thickness d of the fiber composite V. An outflow of the heated air L through interspaces 5 between adjacent blowing nozzles is not possible because of the plates 8.

The blowing orifice 7 of the blowing nozzles 4 is arranged relatively near to the surface 0 of the fiber composite V. It is also conceivable for the distance b to be designed adjustably.

FIG. 3 illustrates a side view of a larger detail from the device according to the invention. FIG. 3 shows nozzle arrangements 2*a* arranged above the fiber composite V on a first side 3*a* and second nozzle arrangements 2*b* arranged below the fiber composite V on a second side 3*b*. The blowing nozzles 4 are in each case combined into groups 12. Thus, groups 12 of blowing nozzles 4 are activated alternately on the top side 3*a* and on the underside 3*b* of the fiber composite V. Simultaneously, groups 12' of blowing nozzles 4' are inactive alternately on the underside 3*b* of the fiber composite V and on the top side 2*a* of the fiber composite V. with respect to the fiber composite V, therefore, in each case inactive blowing nozzles 4' lie opposite active blowing nozzles 4. Whereas, as stated with regard to FIG. 2, the interspace 5 between active blowing nozzles 4 is closed by means of plates 8, the interspace 5 between inactive blowing nozzles 4' is open, so that the air L blown through the fiber composite by the active blowing nozzles 4 can flow out between the inactive blowing nozzles 4'

According to FIG. 3, treatment medium is led through the fiber composite V alternately from the top downward and from the bottom upward.

Of course, it is also conceivable to omit the inactive blowing nozzles 4'. The provision of blowing nozzles on both sides of the fiber composite V, which are activatable or deactivatable, as desired, allows a flexible use of the device according to the invention.

FIG. 4 shows a top view of the fiber composite V conveyed through the device 1. The blowing nozzles 4 are designed as wide-slit nozzles and each have a blowing orifice 7 which extends essentially over the entire width B of the conveying path F. The conveying path F is indicated by two lateral boundaries 19. FIG. 4 shows a first group 12 of active blowing nozzles 4 on the left side. This is followed by a group 12' of inactive blowing nozzles 4'. Active blowing nozzles 4 of a further group 12 of active blowing nozzles are shown on the right side of FIG. 4. The interspace 5 formed between active blowing nozzles 4 is closed by means of the cover plate 8, while the interspace 5 between inactive blowing nozzles 4' remains open, so that air blown in from opposite blowing nozzles can flow out between the inactive blowing nozzles 4'.

FIG. 5 shows diagrammatically a cross section of the device according to the invention, as seen in the conveying direction R. The fiber composite V is led through the device 1 by means of the upper belt 17 and the lower belt 18. The nozzle arrangements 2*a*, 2*b* on both sides 3*a*, 3*b* of the fiber composite V consist of blowing nozzles 4 which are provided with a nozzle box. Typically, two blowing nozzles 4, each with a blowing orifice 7, are provided per nozzle box 9 (see FIG. 5*a*).

The nozzle box 9 has a connecting orifice 10, into which heated air L can be blown by means of a fan 13. The cross section Q of the nozzle box 9 decreases continuously toward a closed end 11 of the nozzle box 9. A uniform emergence of the air L over the entire width of the nozzle box 9 is thereby achieved. The heating device 14 between the fan 13 and the connecting orifice 10 of the nozzle box 9 serves for heating the air L. The fan 13 is designed in a known way as a radial fan. The heating device 14 and a fan 13 can be used in order, for example, to act upon a group 12 (see FIGS. 3 and 4) of blowing nozzles 4 jointly with heated air L.

In order selectively to activate or deactivate blowing nozzles 4 arranged on the top side 3*a* or on the underside 3*b* of the fiber composite V, a pivotable flap 20 is provided. In the position shown in FIG. 5, a flap 20 closes the connecting orifice 10' of the lower nozzle boxes 9, while the connecting orifice 10 of the upper nozzle boxes is opened. In the position illustrated by dashes in FIG. 5, the flap 20 closes the connecting orifice 10 of the upper nozzle boxes 9 and thus activates the nozzle boxes 9 arranged on the underside 3*b* of the fiber composite V, so that air is blown from the bottom upward.

FIG. 6 shows an enlarged illustration of the blowing orifices 7 of two blowing nozzles 4 lying next to one another. The blowing orifices 7 have a width c of 3 mm to approximately 30 mm (in the case of a working-width dependent length of the wide-slit nozzles of 0.5 to a plurality of meters). The blowing orifices 7 are designed as flanged plates which guide the air in a focused manner toward the surface 0 (see FIGS. 2 and 3) of the fiber composite V. Between the adjacent blowing orifices 7, the interspace 5 is closed by means of a push-in plate 8. The push-in plate 8 is designed as a flanged plate. The plate 8 has on both sides an H-shaped cross section, by means of which the plate can be pushed on over a U-shaped flanging 21 at the end of the blowing orifice 7. To activate or deactivate the individual blowing nozzles, on the one hand, the flap 20 shown in FIG. 5 is brought into the desired position. On the other hand, to activate the blowing nozzles, the plates 8 are pushed in between activated blowing nozzles 4 and, to deactivate the blowing nozzles, the plates 8 are removed.

FIG. 7 shows a side view of a plurality of nozzle boxes 9, each with two blowing orifices 7. The nozzle boxes 9 are arranged only on the top side 3*a* of the fiber composite V. Corresponding blowing nozzles may also be provided on the underside 3*b*.

The invention claimed is:

1. A device for consolidating a fiber composite conveyed continuously along a conveying path by action upon said fiber composite with heat or for cooling, with at least one nozzle arrangement on at least one side of the conveying path for blowing a heated treatment medium in the direction of the conveying path, the at least one nozzle arrangement having a plurality of blowing nozzles lying next to one another and arranged at a distance from one another, and an interspace being formed in each case between two adjacent blowing nozzles, wherein the interspace between the blowing nozzles is essentially closed or closable with respect to the conveying path, and the interspace is closed off or may be closed off in such a way that, in the case of predetermined fiber composite and in the case of a predetermined outflow velocity and outflow quantity of the treatment medium from the blowing nozzles, the treatment medium can be blown through the entire thickness of the fiber composite.

2. A device as claimed in claim 1, wherein the interspace between the blowing nozzles is closed in such a way that, between the at least one nozzle arrangement and the fiber composite, a pressure space is formed in which an excess pressure can be generated by means of the blowing nozzles.

3. The device as claimed in claim 1, wherein the blowing nozzles have a blowing orifice which terminates adjacent to the surface of the fiber composite.

4. The device as claimed in claim 3, wherein the distance between the surface of the fiber composite and the blowing orifice is adjustable.

5. The device as claimed in claim 1, wherein the interspaces between the blowing nozzles are closed or closable by means of sealing elements which can be inserted, between the blowing nozzles.

6. The device as claimed in claim 1, wherein the blowing nozzles are designed as wide-slit nozzles which extend essentially over the entire width of the conveying path, and the blowing nozzles are provided with a nozzle box having a cross section which decreases from a connecting orifice, at which treatment medium can be blown into the nozzle box, toward a closed end of the nozzle box.

7. The device as claimed in claim 1, wherein nozzle arrangements are arranged on both sides of the conveying path.

8. The device as claimed in claim 7, wherein a plurality of blowing nozzles are combined into groups, and the groups of blowing nozzles are activatable and deactivatable individually.

9. The device as claimed in claim 8, wherein the interspace between deactivated blowing nozzles is opened or openable.

10. The device as claimed in claim 1, wherein the device is provided with at least one fan and with at least one heating device which are designed in such a way that 500 to 2000 $m^3$ of air per hour, with a temperature of 0 to 300° C. and with a velocity of 0.5 to 70 m per second can be blown against the fiber composite per blowing nozzle and per meter of work width.

11. A method for consolidating a fiber composite by action upon the fiber composite wit heat, comprising steps of conveying the fiber composite along a conveying path blowing a heated treatment medium in the direction of the fiber composite by means of blowing nozzles which are arranged next to one another and which in each case delimit an interspace the interspace being closed off, with the result that an excess pressure is generated in a pressure space continuous to the fiber composite, and the treatment medium being blown through the entire thickness of the fiber composite.

12. The method as claimed in claim 11, wherein the treatment medium is blown into the fiber composite directly by a blowing orifice of the blowing nozzles which is arranged adjacently to the surface of the fiber composite.

13. The method as claimed in claim 12, wherein the distance between the blowing orifice of the blowing nozzle and the surface of the fiber composite is set at a predeterminable value.

14. The method as claimed in claim 11, wherein, as seen in the conveying direction, the treatment medium is blown against the fiber composite alternately from one side and from the other side.

15. The method as claimed in claim 14, wherein groups of blowing nozzles are activated and deactivated alternately on one side of the fiber composite, and the interspace between deactivating blowing nozzles is opened in order to allow the outflow of the treatment medium.

16. The method as claimed in claim 11, wherein the treatment medium is blown out of the blowing nozzles at an outflow velocity of 0.5 to 70 meters per second, and 500 to 2000 $m^3$ per hour of the treatment medium is blown out per blowing nozzle and per meter of working width.

* * * * *